United States Patent [19]

Mobley et al.

[11] Patent Number: 4,640,414

[45] Date of Patent: Feb. 3, 1987

[54] LOCKING TROLLEY FOR GARMENT BAG WITH IMPROVED HANGER RETENTION

[75] Inventors: Lawrence R. Mobley; James S. Gregg, both of Aurora, Colo.

[73] Assignee: Samsonite Corporation, Denver, Colo.

[21] Appl. No.: 754,617

[22] Filed: Jul. 12, 1985

Related U.S. Application Data

[63] Continuation-in-part of Ser. No. 673,353, Nov. 23, 1984.

[51] Int. Cl.[4] ..... B65D 85/18; B25B 5/08

[52] U.S. Cl. ..... 206/287; 24/516; 206/279; 206/291; 206/293; 248/316.2; 248/316.6; 269/236

[58] Field of Search ..... 267/181; 24/564, 507, 24/556, 520, 521, 513–517; 294/147, 143, 162; 269/236; 383/23; 248/316.1–316.8, 340; 206/285, 287, 287.1, 279, 284, 289, 293

[56] References Cited

U.S. PATENT DOCUMENTS

| | | | |
|---|---|---|---|
| 193,143 | 7/1877 | Clearwater | 24/516 |
| 743,454 | 11/1903 | Cohn . | |
| 851,661 | 4/1907 | Hewlett et al. | 269/236 |
| 869,880 | 11/1907 | Conrad | 24/516 |
| 1,512,476 | 10/1974 | Meyer | 269/236 |
| 2,251,800 | 8/1941 | Painter | 24/516 |
| 4,252,220 | 2/1981 | London et al. | 206/287 |
| 4,266,705 | 5/1981 | Wheeler | 294/143 X |
| 4,363,388 | 12/1982 | London et al. | 206/285 X |

FOREIGN PATENT DOCUMENTS

| | | |
|---|---|---|
| 0110233 | 6/1984 | European Pat. Off. . |
| 1280620 | 7/1972 | United Kingdom . |

OTHER PUBLICATIONS

Applicant's submitted prior art of 1968 Trolley on June 25, 1985 as part of paper No. 8.

*Primary Examiner*—William Price
*Assistant Examiner*—Bryon Gehman
*Attorney, Agent, or Firm*—John R. Ley

[57] ABSTRACT

A locking trolley for gripping and locking the hooked ends of hangers in a garment bag includes a C-shaped frame member and a jaw member extending forward from the rear of the C-shaped frame member. Gripping pads for gripping the hooked ends of hangers are located between the lower horizontal portion of the C-shaped frame member and the jaw member. A locking arrangement operatively moves the jaw member toward the lower horizontal portion of the frame member to cause the gripping pads to grip the hanger ends and also locks the jaw member in the hanger gripping position. The locking arrangement preferably takes the form of a locking lever pivotably connected to the forward end of the jaw member. The locking lever pivots between the jaw member and the upper horizontal portion of the frame member to hold the jaw member in the locked position. To release the locked relationship the locking lever is grasped and pivoted between the jaw member and the upper horizontal portion of the frame member. A lip arrangement at the forward end of a gripping pad serves as an obstruction to the movement of the hangers from between the locked trolley. A predetermined structural configuration of the gripping pad increases the compressibility of the resilient gripping pads for better gripping flexibility around the hangers.

32 Claims, 10 Drawing Figures

LOCKING TROLLEY FOR GARMENT BAG WITH IMPROVED HANGER RETENTION

CROSS-REFERENCE TO RELATED APPLICATION

The application for the present invention is a continuation-in-part of U.S. patent application Ser. No. 673,353, filed Nov. 23, 1984, and assigned to the assignee hereof.

The present invention pertains to an improved trolley device for suspending garments on hangers within the interior of a garment bag. More particularly, the present improved trolley operatively locks and holds conventional garment hangers of a variety of different configurations.

BACKGROUND OF THE INVENTION

A trolley is a hanger-suspending device used in a garment bag for suspending the hangers and the clothes on the hanger from a top central location within the garment bag. Usually trolleys and the hangers which are suspended therefrom are of special configurations to mate with one another. The special hangers generally have a very short, a nonexisting, or pivoting neck in order to place the shoulders of the garments on the hangers very near the top of the garment bag. With the shoulder position near to the top of the bag, less space in the corners and along the top of the bag is wasted.

Users must transfer their clothes from the typical clothes hanger having a relatively long neck on to the special garment bag hangers in order to use the garment bag. One of the significant disadvantages of this arrangement, other than the inconvenience of changing hangers, is that the capacity for packing clothes is generally limited by the number of hangers supplied with the garment bag.

Many of the conventional trolley and special hanger combinations are ineffective in preventing the hangers from coming loose from the trolley, particularly when the garment bag is of the type used in traveling which is folded into a suitcase-like configuration. When the garment bag is folded into the suitcase like configuration, the upper portions of the clothes become inverted. The weight of the clothes tends to pull them away from the inverted hanger. The clothes usually become wrinkled when they fall off of the hangers or when the hangers become loose from the trolley and fall off.

Although not in widespread use, trolleys which have the capability for locking conventional garment hangers within a garment bag are known. Such prior locking trolleys, however, are difficult and awkward to use, or are not adapted for use with traveling garment bags. The pivoted jaw portions of such trolleys are connected to the sides of the garment bag to grasp the necks of conventional hangers extending out of the bag, or the clamping jaw is freely pivoted and is incapable of supporting the hanger from its hook-shaped end without first locking the trolley. Users must lock each hanger into the trolley to prevent all of the garments from falling. This is a substantial disadvantage when packing the garment bag because the trolley must be locked and unlocked each time a new hanger and garment is added.

Furthermore, the locking mechanism of such prior locking trolleys is inconvenient for single handed operation. Locking the prior locking trolley requires alignment of a locking bail and manipulation of a locking handle. Since the user is holding the garments on the hangers in one hand, aligning the bail and manipulating the locking handle is difficult to accomplish with only the other hand. This difficulty is particularly aggravated if the user must also support the weight of all the previously packed garments to prevent them from falling each time the trolley is unlocked and locked to pack another garment.

Another disadvantage inherent in many previous trolleys is a tendency for the hooked end of the hangers to move from between the pivoted jaw portions as a result of vibration during transportation. The hangers may tend to collect or bunch together or may fall off of the trolley. The garments on the hangers may become wrinkled when the hangers become disoriented, or fall from the trolley into the garment bag.

SUMMARY OF THE INVENTION

One objective of the present invention is to provide a new and improved locking trolley which is compatible for use with all types and configurations of conventional hangers. Another objective of the present invention is to provide a locking trolley which is more convenient for use than any previously known locking trolley, particularly in the regard of allowing the user to pack and unpack the garment bag without locking and unlocking the trolley each time a garment is added or removed. Still another objective of the present invention is to provide a new and improved locking trolley which allows the user to lock and unlock the trolley conveniently with single-handed manipulation. A further objective of the present invention is to provide a new and improved locking trolley which achieves the foregoing and other advantages while preventing or resisting the hangers from falling off of the locking trolley when the trolley is locked during transportation of the garment bag, or when the trolley is unlocked for loading or unloading the garments on hangers from the garment bag.

In accordance with its principal aspects, the locking trolley of the present invention comprises a C-shaped frame member defined by an upper horizontal portion, a spaced apart lower horizontal portion and a vertical portion connecting the rear of the two horizontal portions. A jaw member is operatively connected to the C-shaped member and extends forward between the upper and lower horizontal portions through the space defined by the C-shaped frame member. Gripping structures are connected to the lower horizontal portion and to the jaw member, and the gripping structures face one another. The operative connection of the jaw member to the frame member moves the jaw member toward the lower horizontal portion thereby bringing the gripping structures into hanger-end gripping adjacency to grip hooked ends of conventional hangers. The gripping structures are preferably of a sufficiently resilent material to compress around the ends of hangers of various different cross sectional sizes and configurations. The jaw member can also be maintained in a locked position in which the gripping structures operatively grip the hooked ends of the hangers. Locking is preferably achieved by a locking lever pivotably connected to the forward end of the jaw member. The locking lever includes a cam surface which operatively slides along a portion of the frame member to move the jaw member into the locked position.

Because the lower horizontal portion of the frame member is rigidly connected to the garment bag through the C-shaped frame structure, the user can conveniently suspend all of the hangers and garments from the lower horizontal portion until the locking trolley is filled to capacity. At that time, the locking trolley is conveniently manipulated to lock the hangers in place on the trolley. Similarly, when the trolley is unlocked, the jaw member separates from the lower horizontal frame portion and the gripping structures move out of contact with the hanger ends to provide an unobstructed access area for removing or adding the hangers.

In accordance with another one of its aspects, the locking trolley of the present invention includes a lip arrangement at the forward end of the gripping structure associated with the lower horizontal portion of the C-shaped frame member. The lip arrangement extends above an upper horizontal surface of the lower gripping structure to provide an impediment or obstacle to hangers moving from between the two gripping structures when they are held in hanger-end gripping adjacency as a result of moving the locking lever to force the jaw member into the locked position. The lip arrangement also aids in retaining the hanger ends on the lower gripping structure when the jaw member is in the unlocked position, during loading and unloading of the garment bag. Preferably the lip arrangement is formed as an integral part of the forward end of the lower gripping structure, and preferably the lower gripping structure is formed of resilient compressible material. To increase the compressibility of the resilient material of the gripping structures, the gripping structures may be formed in predetermined structural configurations. The predetermined structural configurations allow the resilient material to more readily compress around the hanger ends and thereby hold them more securely between the gripping structures. The added compressibility also resists the movement of the hanger ends from between the gripping structures due to vibration and the like during transportation.

The features and specific details of the present invention can be more completely understood by reference to the following description of the preferred embodiment taken in conjunction with the drawings, and from the appended claims.

DESCRIPTION OF PREFERRED EMBODIMENTS

Figure 1:
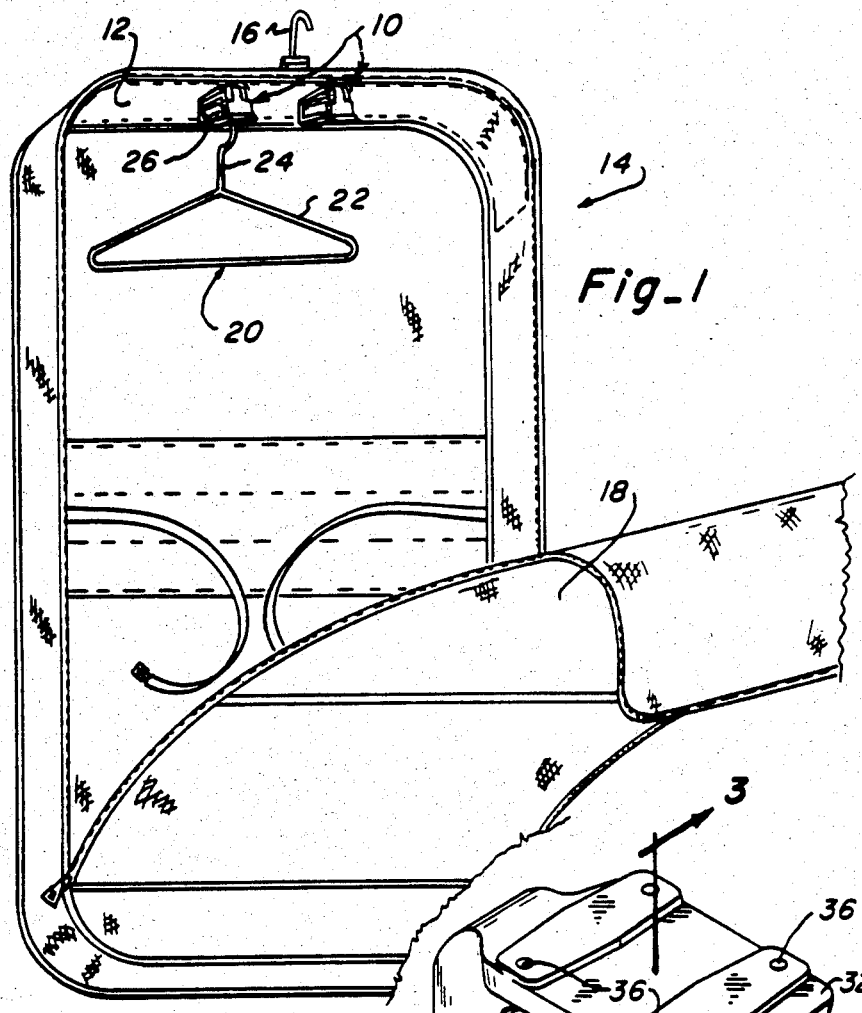
FIG. 1 is a perspective view of an open garment bag suspended from its upper end and illustrating a pair of locking trolleys of the present invention connected at a center interior location to an upper side gusset of the garment bag and with a portion of an interior panel broken out.

A pair of trolleys 10 of the present invention are illustrated in FIG. 1 connected to the interior of a top side gusset 12 of a garment bag 14. The garment bag 14 is suspended from an upper hook 16 connected to the outside of the top side gusset 12. The interior of the bag 14 is exposed as a result of an interior panel 18 being opened or unzipped and folded in a downward position. Clothes (not shown) are suspended from hangers 20 within the interior space of the garment bag 14. Each hanger 20 is suspended from one of the trolleys 10. Each hanger is of the conventional configuration having a bottom triangular shaped shoulder supporting structure 22, a neck 24 extending upward from the shoulder supporting structure 22, and a hooked end 26 extending from the neck 24. The hooked end 26 is received in the trolley 10.

Figure 2:
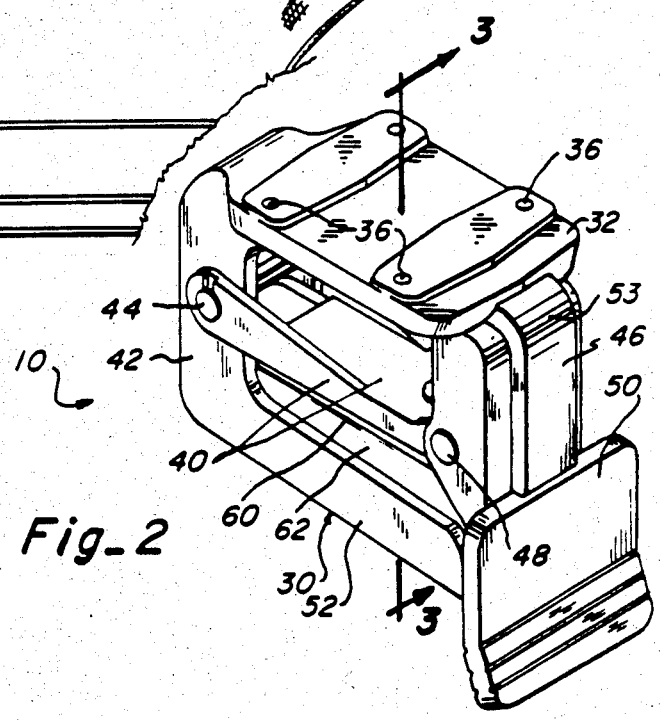
FIG. 2 is a perspective view of one locking trolley of the present invention.
Figure 3:
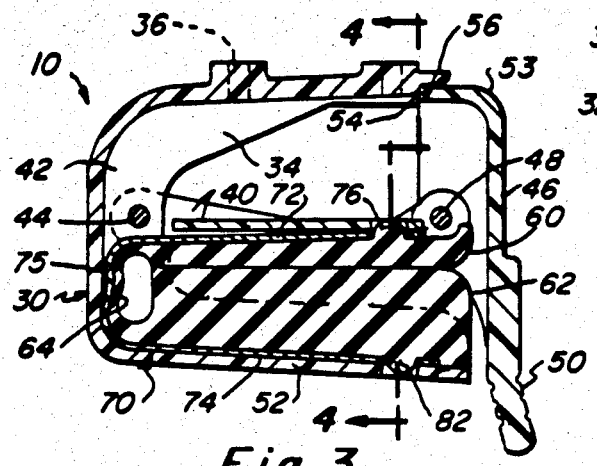
FIG. 3 is a section view of FIG. 2, taken substantially in the plane of line 3—3.
Figure 4:
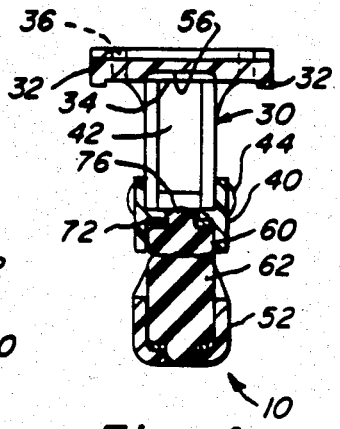
FIG. 4 is a section view of FIG. 3, taken substantially in the plane of line 4—4.

Details of one trolley 10 are better understood by reference to FIGS. 2, 3 and 4. The trolley 10 will be described and claimed in relation to the orientation shown in FIGS. 2, 3 and 4. The trolley 10 includes a C-shaped main frame member 30. A pair of flanges 32 extend transversely outward on opposite sides of an upper horizontal portion 34 of the C-shaped frame member 30. Holes 36 are formed through each of the flanges 34 for the purpose of receiving rivets or other fasteners (not shown) to attach the trolley 10 to the interior surface of the top side gusset 12 (FIG. 1).

A clamping jaw member 40 is operatively and pivotably connected to a rear vertical portion 42 of the C-shaped frame member 30 by a pin 44. The clamping jaw member 40 extends forwardly to a front end where a locking level 46 is pivotably connected thereto by another pin 48. The locking lever 46 includes a finger grasping portion 50 which extends below a bottom horizontal portion 52 of the C-shaped frame member 30 when in the locked position shown in FIG. 3. An upper surface portion 53 of the locking lever 46 curves upwardly and rearwardly and terminates at a perpendicular locking edge structure 54. The locking edge 54 abuts a transversely extending locking shoulder structure 56 in the locked position. The locking shoulder 56 is formed in the forward inside edge of the upper horizontal leg portion 34 of the frame member.

Figure 6:
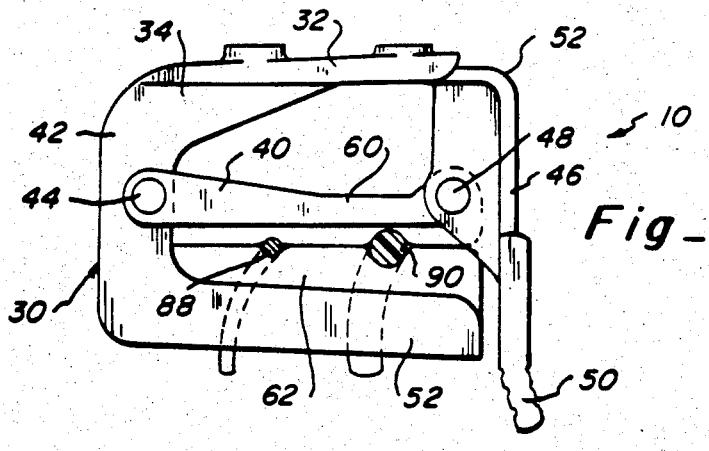
FIG. 6 is a side elevational view of the locking trolley similar to FIG. 5, illustrating the locked position of the trolley and two hook shaped ends of conventional hangers of different configurations shown in cross section locked in the trolley.

Gripping structures in the form of pads 60 and 62 are located in opposite facing relationship in the trolley 10. The upper gripping pad 60 is received within a U-shaped channel of the clamping jaw member 40, as is illustrated in FIG. 4. The cross sectional configuration of the bottom horizontal leg portion 52 of the C-shaped frame 30 also defines a U-shaped channel as is illustrated in FIG. 4, and the bottom gripping pad 62 is seated within this U-shaped channel. Both gripping pads 60 and 62 are connected by a thin web 64 of material adjacent the rear vertical portion 42 of the C-shaped frame member 30. The gripping pads 60 and 62 and the web 64 are formed of flexible and compressible resilient material, such as rubber, flexible plastic or the like. The flexibility of this material allows it to conform around the cross sectional configuration of a variety of different sizes and shapes of hook shaped end portions of hangers, as is illustrated in FIG. 6. This flexibility can also be increased by forming voids such as cylindrical holes in the pads 60 and 62, the axes of which are oriented generally parallel to the axis of the pin 44. (See FIGS. 7, 8 and 9.)

Figure 5:
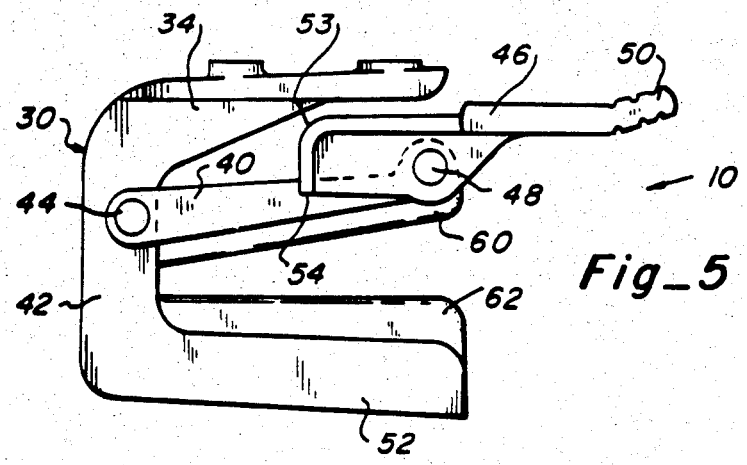
FIG. 5 is a side elevational view of the trolley shown in FIG. 2, illustrating its unlocked position.

An elongated U-shaped spring strip 70 also fits within the opposed facing U-shaped channels of the clamping jaw member 40 and the bottom horizontal portion 52. The spring strip 70 is formed of spring metal and is biased to pivot the jaw member 40 counterclockwise with respect to the bottom horizontal portion 52 and toward the upper horizontal portion 34, as shown in FIG. 5. A flat forward projecting upper leg portion 72 of the spring strip 70 fits between the upper gripping pad 60 and the flat interior wall of the U-shaped channel of the jaw member 40. Similarly, a flat forward projecting lower leg portion 74 of the spring strip 70 fits between the lower gripping pad 62 and the interior flat wall of the U-shaped channel of the bottom horizontal portion 52. A curved portion 75 of the spring strip joins the two leg portions 72 and 74 and is positioned adjacent the rear vertical portion 42 of the frame member 30. A projection 76 extends upward from the gripping pad 60 through aligned holes in the leg portion 72 of the spring strip 70 and in the bottom wall of the channel of the jaw member 40. Similarly, a projection 82 extends downward from the gripping pad 62 through aligned holes in the leg portion 74 of the spring strip 70 and in the inner wall of the U-shaped channel of the lower leg portion 42 of the C-shaped member 30. The friction fit between the projections 76 and 82 and their aligned holes operatively holds or retains the spring strip 70 and the gripping pads 60 and 62 between the lower horizontal leg portion 52 and the jaw member 40 and within their U-shaped channels.

In an alternative retaining arrangement, the projections 76 and 82 can be formed within enlarged heads, such that the heads are slightly larger than the holes in the leg portions 72 and 74 of the spring strip 70. Such heads would then be compressed to pass through the aligned holes in the spring strip and in the jaw member 40 and lower horizontal leg portion 52 and, upon expanding, retain the gripping pads 60 and 62 in position. The holes in the spring strip 70 may be formed by punching a forward opening C-shaped slot (not shown) into the spring strip, and then bending the tabs (not shown) formed by the interior of the C-shaped slot toward the forward ends of the spring strip 70. Such tabs are then inserted into the holes of the lower horizontal portion 52 and in the jaw member 40 to mechanically hold the spring to the jaw member and the frame member. The tabs serve as means to resist the withdrawal of the gripping pads or the spring strip from the trolley, either because of the bias force from the spring strip or because of the forces created by removing hanger ends from the trolley.

The biasing force from the spring strip 70 tends to pivot the jaw member 40 counterclockwise about the pin 44 away from the lower horizontal leg portion 52 and the lower gripping pad 62, as shown in FIG. 5. Of course, the locking lever 46 must be pivoted counterclockwise to an unlocked position, as is also shown in FIG. 5, in order to allow the jaw member 40 to pivot to an open position. The upper gripping member 60 moves in unison with the jaw member 40 because of a resilient compressed fit within the U-shaped channel and the effects of the upper projection 76 (FIG. 4).

Locking and unlocking the trolley 10 is conveniently accomplished with single handed manipulation. The user simply grasps the grasping portion 50 of the locking lever 46 and lifts upward. The lower grasping portion 50 of the locking lever extends below the lower horizontal portion 52 of the frame member so it is accessible for lifting by a finger. The locking edge 54 slides inward along the locking shoulder 56 (FIG. 3) and releases the locked connection. The spring strip 70 thereafter lifts the clamping jaw member 40 and exposes a space between the gripping pads 60 and 62 for the user to insert or remove the hook shaped ends of hangers (FIG. 5). As the clamping jaw member 40 pivots counterclockwise as shown in FIG. 5, the upper curved surface 53 of the locking lever 46 slides along the interior surface of the upper horizontal portion 34 until the locking lever 46 has pivoted sufficiently counterclockwise to separate the surface 53 from the interior surface of the upper horizontal portion 34. The locking lever thereby pivots to a generally forward extending position as shown in FIG. 5 and exposes the area between the separated gripping pads 60 and 62 for unobstructed movement of the hooked ends of the hangers.

The resilient compressible characteristics of the gripping pads 60 and 62 allow hook shaped hanger ends of a variety of different sizes and configurations to be securely gripped, as shown in FIG. 6. The resilient material of the gripping pads compresses and deforms around the different sizes and shapes of hangers. Accordingly, the conventional wire hangers 88 or the newer thicker plastic hangers 90 can both be readily accommodated by the trolley 10.

If a small wire hanger 88 is positioned between two closely spaced larger plastic hangers 90 (the situation is not shown), the gripping pads 60 and 62 may not adequately contact the smaller wire hanger. It is for this reason that two trolleys 10 are provided in the garment bag 14 as shown in FIG. 1. The user will place all of the larger hangers on one of the trolleys and place all of the smaller hangers on the other trolley. Each trolley can thereby firmly grip both types of hangers. Of course, if the space is sufficient between the smaller hanger 88 and the larger hanger 90 on a single trolley, as is illustrated in FIG. 6, the gripping pads 60 and 62 will deform sufficiently to grip both depending on the flexibility of the gripping material. Another advantage of providing two trolleys in the garment bag as shown in FIG. 1 is that the hangers enclosed can be alternately packed on the trolleys to obtain a greater clothes packing capacity in the bag 14 than if a single trolley was used.

To close the trolley 10 and thereby lock the hangers in place, as shown in FIG. 6, the user pivots the locking lever 46 in a clockwise direction. This pivoting action is conveniently achieved by pressing with the thumb on the forward surface of the finger gripping portion 50. As the locking lever pivots clockwise, the rounded surface portion 53 of the upper end of the locking lever 46 acts as a cam surface and slides along the interior surface of the upper horizontal portion 34 of the C-shaped frame 30. The curved surface 53 creates a camming effect which moves the jaw member 40 toward the lower horizontal portion 52 of the frame member, thus deforming the gripping pads 60 and 62 around the hanger ends 88 and 90. As the locking lever 46 continues its clockwise pivoting movement, the locking edge 54 ultimately snaps over the locking shoulder 56 as shown in FIG. 3. Substantial greater clockwise pivoting movement is prevented because the finger gripping portion 50 comes into close adjacency or contact with the front edge of the lower horizontal portion 52. The locking relationship is maintained by the locking lever due to the upward force on the locking lever 46 which prevents the locking edge 54 from sliding below the locking shoulder 56. The upward force on the locking lever 46 results from the force of the compressed resilient gripping pads 60 and 62 and the effects of the spring strip 70. The amount of upward force on the locking lever 46 is sufficient to prevent accidental disconnection of this locking relationship, thus securely holding the hangers on the trolley 10. However, when manual force is applied to the locking lever 46, the gripping pads 60 and 62 will compress sufficiently to allow the locking edge 54 to pass below the locking shoulder 56.

The C-shaped frame member 30, the jaw member 40 and the locking lever 46 are preferably formed of polycarbonate plastic. Of course, the pins 44 and 48 and the spring strip 70 are formed of metal. The polycarbonate plastic has excellent characteristics for inhibiting breakage from impacts and other forces. Of course, the polycarbonate material can be molded for ease of construction and will present an attractive exterior appearance.

One of the substantial advantages of the present invention is that the trolley 10 will suspend hangers and garments from the hangers without the necessity to lock and unlock it each time that a new hanger is added to or taken from the trolley. In known prior locking trolleys, the bottom jaw member of the locking portion is pivoted and is in a hanger supporting position only when locked. When unlocked the lower jaw member is free to pivot downward. On packing the garment bag the user will usually suspend one garment and hanger from the trolley at a time. In between times, the user is readying the next garment on the next hanger so it too may be packed. Locking the prior trolley to hold the previously packed garments and hangers in between times when new garment is added to the trolley is a substantial inconvenience. Furthermore, the inconvenience is compounded by the fact that once the prior locking trolley is unlocked, the downward pivoting lower jaw member will drop the previously packed garments unless the jaw member is held. The user must not only unlock the prior locking trolley but must also hold the lower jaw upward to prevent the already packed garments from falling. Substantial force is required, particularly when a large number of garments have been connected to the trolley. By contrast, as many hangers and attached garments as the present trolley 10 will hold can easily be suspended from the lower horizontal portion 52 and gripping pad 62 while the trolley is in the unlocked position (FIG. 5). The rigid structure of the C-shaped frame member 50 prevents the previously packed garments from tending to spill off of the lower gripping pad 62. The spring strip 70 holds the jaw member 40 in the upward position and the locking lever 46 in the forward extending position, thus exposing the full space between the gripping members 60 and 62 for the insertion of the hook shaped hanger ends. When the trolley is fully packed, the user easily locks it by moving the locking handle to the locked position. The locking trolley 10 of the present invention therefore obtains substantial advantanges in its use, as compared to known prior locking trolleys.

Figure 7:
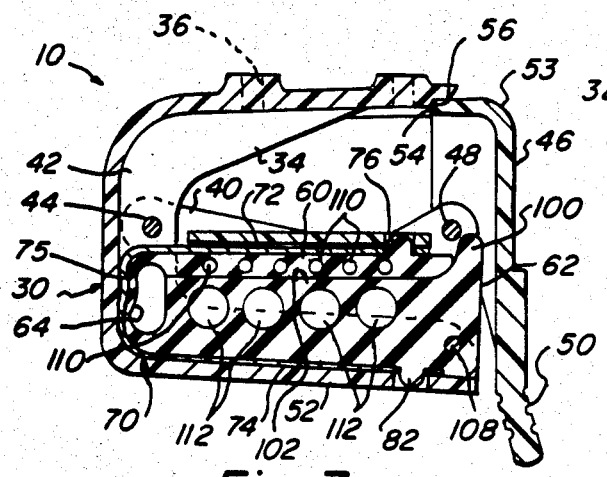
FIG. 7 is a section view similar to FIG. 3, illustrating an alternative embodiment of a gripping structure of the locking trolley of the present invention.
Figure 8:
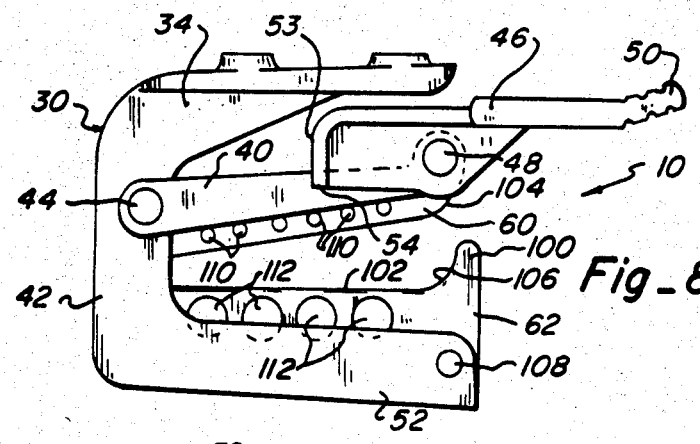
FIG. 8 is a side elevational view of the locking trolley shown in FIG. 7, illustrating its unlocked position.
Figure 9:
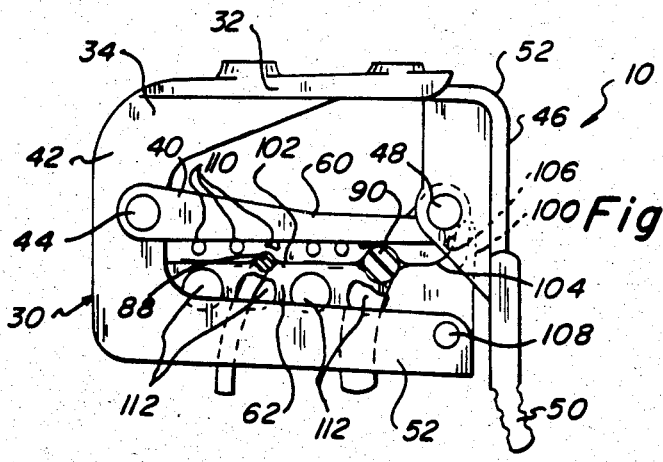
FIG. 9 is a side elevational view of the trolley shown in FIG. 7, illustrating the locked position of the trolley and two hook-shaped ends of conventional hangers of different configurations shown in cross-section locked in the trolley.

To prevent the hanger ends from moving or sliding off of the trolley, when it is either in its locked or unlocked position, a lip structure 100 is located adjacent the forward end of the lower gripping pad 62, as is shown in FIGS. 7, 8 and 9. The lip 100 extends upward above an upper horizontal surface 102 of the lower gripping pad 62. The lip 100 thereby serves as a means operative at the forward end of the two opposed gripping pad structures 60 and 62 for preventing the withdrawal of the hanger ends, except when the trolley 10 is in its unlocked position illustrated in FIG. 8. In the closed position of the trolley as is illustrated in FIGS. 7 and 9, a curved surface 104 of the forward end of the upper gripping pad 60 contacts or adjoins a rearward facing curved surace 106 of the lip 100 to present an obstructed pathway through which hanger ends would have to move when the trolley is in the locked position in order for the hangers to fall off of the trolley. Furthermore, the upward extension of the lip 100 generally extends in close adjacency to the rearward facing surface of the locking lever 46 when the trolley is locked. In order for a hanger end to move from between the gripping pads 60 and 62 when the trolley is locked, the lip 100 would have to be deflected first so that a sufficient pathway exists between the curved surfaces 104 and 106 and secondly so that a pathway exists between the lip portion and the rear surface of the locking lever 46. Such a two-part reverse deflection is impossible or improbable with a lip 100 of the configuration illustrated. Accordingly, no pathway is provided whereby the hanger ends could move from between the gripping pads 60 and 62 when the trolley is in the locked position.

When the trolley is in the unlocked position as is illustrated in FIG. 8, a sufficient pathway exists between the lip 100 and the upper gripping pad 60 to allow the hanger ends to be freely moved between the gripping pads 60 and 62. Even in the unlocked position the lip 100 prevents the hanger ends from sliding off of the lower gripping pad 62 when the trolley is being loaded. Thus, the lip 100 serves the further convenience of assisting in retaining the hangers on the trolley during loading without the necessity or requirement for manual retention or locking, as is common with prior trolleys.

A rivet 108 extends through the lower gripping member 62 and through appropriate holes formed in the upward extending side portions of the U-shaped channel of the lower horizontal leg portion 52 of the frame 30. The rivet 108 also serves as means for resisting the withdrawal of the gripping pads from the trolley, due to, for example, forces created during vibration of the trolley during transportation of the garment bag.

Depending upon the flexibility of the particular resilient material selected for the gripping pads 60 and 62, additional compressibility of less resilient material can be achieved for improved retention of the hanger ends in the trolley when locked. Examples of structural means formed in each of the gripping pads for achieving increased compressibility over the resiliency inherent in the material of the gripping pads themselves, are the cylindrical holes 110 and 112 shown in FIGS. 7, 8 and 9. Relatively small diameter holes 110 are formed in the upper gripping member 60. The relatively small diameter holes are necessary because of the relatively small vertical height or thickness of the upper gripping member 60. Larger holes 112 are formed in the relatively thicker lower gripping pad 62. Since the thinner gripping pads will inherently provide less compressibility, more of the smaller holes 110 are formed in the upper gripping pad 60. A lesser number of larger holes 112 are formed through the thicker lower gripping pad 62. As is shown in FIG. 9, operating the trolley 10 to its locked position causes the holes 110 and 112 in the area surrounding each of the hanger ends to deform out of the circular shape, thereby allowing the resilient material of the gripping pads to compress substantially more than would be possible if the holes 110 and 112 were not provided. A greater contact or gripping surface is achieved around each of the hanger ends due to increased compressibility. The hanger ends are better retained against unintentional movement in the locked trolley. The increased compressibility of the gripping pads will more readily accommodate a variety of different cross-sectional sizes of hanger ends, eliminating, in some circumstances, the necessity for providing two trolleys in a single garment bag as is illustrated in FIG. 1.

Figure 10:
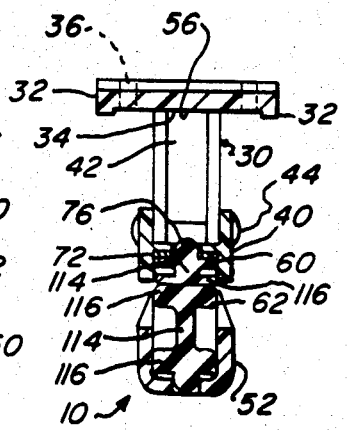
FIG. 10 is a cross-sectional view similar to that shown in FIG. 4, illustrating another embodiment of gripping structures for use in the locking trolley of the present invention.

Another example of structural means for providing increased compressibility within the resilient gripping pads 60 and 62 is illustrated in FIG. 10. Each gripping pad 60 and 62 is formed to have a generally "I"-shaped configuration extending substantially the length of each gripping pad, from its rear end adjacent the rear vertical portion 42 of the frame 30 (FIG. 5) to its forward end adjacent the locking layer 46 (FIG. 3). A relatively narrow central web 114 of the I-shaped configuration provides the increased flexibility to allow a wider contact portion 116 of each gripping pad to compress more readily around the hanger ends.

A variety of other structural configurations or means for increasing the flexibility are also possible. In general these alternative configurations will involve holes extending transversely through the gripping pads, or a web or webs of reduced width at one or more locations along the length of the gripping pads, or a combination of both holes and webs.

The nature and operation of the present invention has been shown and described with a degree of specificity. It should be understood, however, that the specificity of the description has been made by way of preferred example and that the invention is defined by the scope of the appended claims.

What is claimed is:

1. A locking trolley for suspending and retaining hooked ends of clothes hangers within the interior of a garment bag, comprising:

a substantially rigid frame member of generally C-shaped configuration having an upper horizontal portion, a back vertical portion extending downward from the rear of the upper horizontal portion, and a lower horizontal portion extending forward from the lower end of the back vertical portion, the upper and lower horizontal portions being vertically separated by a space open at the front of the C-shaped frame member and closed at the rear of the frame member by the back vertical portion;

a jaw member pivotably connected at a rear end thereof to the vertical portion of the frame member and extending forward through the space at a location between the upper and lower horizontal portions and terminating at a forward end thereof;

a gripping structure connected to the jaw member and facing the lower horizontal portion of the frame member;

a gripping structure connected to the lower horizontal portion of the frame member and facing the jaw member;

the gripping structures contacting and retaining the hooked ends of the hangers when in operative hanger-end gripping adjacency with one another upon a predetermined degree of pivoting movement of the jaw member toward the lower portion of the frame member; and the gripping structures separating to allow free movement of the hanger ends therebetween upon a predetermined degree of pivoting movement of the jaw member away from the lower portion of the frame member;

lip means extending above and at the forward end of the gripping structure connected to the lower horizontal portion of the frame member; and a lever pivotably connected to the forward end of the jaw member, the lever having a lower end and an upper end extending in respectively opposite directions from the location at which the lever is pivotably connected to the jaw member, the lever pivoting between a first position in which its upper end extends into the space between the jaw member and the upper portion of the frame member and its lower end extends forward of the front end of the jaw member and a second position in which the lever generally extends across the space at the front of the C-shaped member; the upper end of the locking lever including means operatively contacting and moving along the upper portion of the frame member for pivoting the jaw member about its rear end into a generally aligned relation with the lower horizontal portion of the frame member in which the gripping structure on the jaw member is in hanger-end gripping adjacency with the gripping structure of the lower portion of the frame member as the lever is moved into the second position;

said lip means presenting an obstruction to the movement of the hanger ends from between the gripping structures at the forward ends of the gripping structures when the lever is moved into the second position.

2. A locking trolley as defined in claim 1 wherein the frame member and the lever further include:

locking means operative for maintaining the jaw member in a position in which the gripping structures are positioned in hanger-end gripping adjacency when the lever is in the second position.

3. A locking trolley as defined in claim 2 wherein said lip means extends above the gripping structure connected to the lower portion of the frame member and in front of the forward end of the gripping structure connected to the jaw member when the lever is moved to the second position.

4. A locking trolley as defined in claim 3 wherein said locking means comprises:

a locking structure at the upper end of the lever;

a complementary locking structure at the forward end of the upper portion of the frame member; and the locking structure of the lever and the complementary locking structure of the upper portion of the frame member operatively contacting one another when the lever is in the second position.

5. A locking trolley as defined in claim 4 wherein:
the lower end of the lever extends below the lower horizontal portion of the frame member when the lever is in the second position, and
the lower portion of the lever includes a portion adapted to be grasped.

6. A locking trolley as defined in claim 4 wherein:
the locking structure on the upper end of the lever is an edge which faces rearward,
the complementary locking structure on the forward end of the upper horizontal portion is a shoulder which faces forward, and
the edge abuts the front of the shoulder when the lever is in the second position.

7. A locking trolley as defined in claim 6 wherein the lever includes a cam surface portion which is adapted to slide along the inner surface of the upper horizontal portion of the frame member when the lever is pivoted into the second position.

8. A locking trolley as defined in claim 7 further comprising:
spring means operative between the jaw member and the frame member for biasing the jaw member away from the lower horizontal portion of the frame member.

9. A locking trolley as defined in claim 8 wherein the spring means is a spring strip having a configuration in which a leg portion extends into contact with one horizontal portion of the frame member and in which another leg portion extends into contact with the jaw member.

10. A locking trolley as defined in claim 9 wherein the spring strip is of a U-shaped configuration, and one leg portion thereof extends along the jaw member and another leg portion thereof extends along the lower horizontal portion of the frame member, and a curved portion connects the two straight leg portions and is located adjacent to the vertical portion of the frame member.

11. A locking trolley as defined in claim 10 wherein the gripping structures each comprise elongated gripping pads of resilient compressible material extending along the jaw member and the lower horizontal portion of the frame member, the elongated gripping pads contacting one another when the lever is in the second position, the lip means comprising a lip portion of the resilient compressible material of the lower gripping pad.

12. A locking trolley as defined in claim 11 wherein the jaw member and the lower portion of the frame member are both channel shaped in cross sectional configuration to thereby define channels extending therealong, and the gripping pads are received within the channels.

13. A locking trolley as defined in claim 12 wherein each leg portion of the spring strip is located within one of the channels.

14. A locking trolley as defined in claim 13 further comprising means for retaining the leg portions of the spring strip and the gripping pads in the channels.

15. A locking trolley as defined in claim 3 further comprising means operatively connected between the jaw member and the frame member for biasing the jaw member to pivot away from the lower horizontal portion of the frame member.

16. A locking trolley as defined in claim 3 wherein the gripping structures are resiliently compressible to deflect around the hooked ends of hangers, and the lip means comprises a lip portion of the lower resiliently compressible gripping structure.

17. A locking trolley as defined in claim 16 wherein the resiliency is sufficient to compress the pads around multiple different sizes of hooked ends of hangers.

18. A locking trolley as defined in claim 2 wherein:
said lip means comprises a lip structure having a rearward-facing curved surface extending above an upper surface of the gripping structure connected to the lower portion of the frame member;
the gripping structure connected to the jaw member terminates at a forward end in a structure having a forward-facing curved surface extending above a lower surface of the gripping structure connected to the jaw member; and
the two curved surfaces generally adjoin one another when the lever is in the second position to present an obstructed pathway through which the hanger ends must move in order for the hanger ends to forward move off of the gripping structures.

19. A locking trolley as defined in claim 18 wherein the lip structure is positioned adjacent to the rearward facing surface of the lower end portion of the lever when the lever is in the second position.

20. A locking trolley as defined in claim 19 wherein the adjacency of the lip structure and the rear surface of the lower end portion of the lever requires rearward deflection of the lip structure to create a sufficient pathway for hanger ends to move between the lower end portion of the lever and the lip structure when the lever is in the second position.

21. A locking trolley as defined in claim 20 wherein the gripping structure connected to the lower portion of the frame and the lip structure comprise resiliently compressible material.

22. A locking trolley as defined in claim 2 wherein the means contacting and moving along the upper portion of the frame includes a cam surface portion which is adapted to slide along the inner surface of the upper horizontal portion when the lever is pivoted into the second position.

23. A locking trolley adapted to be operatively connected to the interior surface of a top side gusset of a garment bag, and operative for suspending the hooked ends of clothes hangers within the interior of a garment bag on a non-inclined gripping structure when the trolley is in an unlocked condition, and operative for retaining the hooked ends of hangers on the gripping structure when the trolley is in a locked condition, comprising:
a substantially rigid frame member of generally C-shaped configuration having an upper horizontal portion, a back vertical portion extending downward from the rear of the upper horizontal portion, and a lower horizontal portion extending forward from the lower end of the back vertical portion, the upper and lower horizontal portions being vertically separated by a space open at the front end of the C-shaped frame member and closed at the rear end of the C-shaped frame member by the back vertical portion;
means for connecting the frame member to the garment bag with the upper portion of the frame member positioned facing the top side gusset and the lower portion positioned below the upper portion;
a jaw member extending generally forward through the space defined by the C-shaped frame member;

a gripping structure connected to the lower portion of the frame member and facing the jaw member, the gripping structure extending in a generally non-inclined and horizontal manner to contact and suspend the hooked ends of the hangers when the trolley is in the unlocked condition and to contact and retain the hooked ends of the hangers when the trolley is in the locked condition;

means connecting the jaw member to the frame member and operative for moving the jaw member toward the lower horizontal portion of the frame member to position the hanger ends in gripping adjacency and retention with the gripping structure when the trolley is in the locked condition, and operative for moving the jaw member away from the lower horizontal portion of the frame member to release the hanger ends for free suspension on the gripping structure and to provide an access opening in the space between the gripping structure and the jaw member when the trolley is in the unlocked condition;

selectively operable locking and unlocking means operatively connected between the jaw member and the frame member for maintaining the jaw member positioned toward the lower portion of the frame member to maintain the locked condition of the trolley and for releasing the jaw member for movement away from the gripping structure to achieve the unlocked condition of the trolley; and means at the forward end of the gripping structure for obstructing movement of a hanger and from between the forward end of the gripping structure and the jaw member when the trolley is in the locked condition.

24. A locking trolley as defined in claim 23:

further comprising a lever pivotably connected to the jaw member, the lever having a portion extending away from a location at which it is pivotably connected to the jaw member, the lever being pivotable into a position in which the portion of the lever extends from the pivotable connection on the jaw member to a location adjoining the forward end of the lower portion of the frame member when the trolley is in the locked condition; and wherein the means for obstructing movement comprises a lip structure extending above the gripping structure at the forward end of the lower portion of the frame member.

25. A locking trolley as defined in claim 24 wherein the lip structure adjoins a rearward facing surface of the lever portion when the lever portion extends to a location adjoining the forward end of the lower portion of the frae member.

26. A locking trolley as defined in claim 25 wherein:

the lip structure has a rearward-facing curved surface extending above an upper surface of the gripping structure;

the jaw member includes means connected thereto defining a forward end structure having a forward-facing curved surface; and the two curved surfaces generally adjoin one another when the trolley is in the locked condition.

27. A locking trolley as defined in claim 26 wherein the lip structure is positioned adjacent to the lever portion when the lever extends to a location adjoining the forward end of the lower portion of the frame member.

28. A locking trolley as defined in claim 27 wherein the adjacency of the lip structure and the lever portion requires rearward deflection of the lip structure to create a sufficient pathway in which for hanger ends to move therebetween.

29. A locking trolley as defined in claim 28 wherein the gripping and lip structures are resilient compressible material.

30. A locking trolley adapted to be operatively connected to the interior surface of a top side gusset of a garment bag, and operative for suspending the hooked ends of clothes hangers within the interior of a garment bag on a non-inclined resilient gripping structure when the trolley is in an unlocked condition, and operative for retaining the hooked ends of hangers on the resilient gripping structure when the trolley is in a locked condition, comprising:

a substantially rigid frame member of generally C-shaped configuration having an upper horizontal portion, a back vertical portion extending downward from the rear of the upper horizontal portion, and a lower horizontal portion extending forward from the lower end of the back vertical portion, the upper and lower horizontal portions being vertically separated by a space open at the front end of the C-shaped frame member and closed at the rear end of the C-shaped frame member by the back vertical portion;

means for connecting the frame member to the garment bag with the upper portion of the frame member positioned facing the top side gusset and the lower portion positioned below the upper portion;

a jaw member extending generally forward through the space defined by the C-shaped frame member;

a resilient gripping structure connected to the lower portion of the frame member and facing the jaw member, the gripping structure extending in a generally non-inclined and horizontal manner to contact and suspend the hooked ends of the hangers when the trolley is in the unlocked condition and to contact and retain the hooked ends of the hangers when the trolley is in the locked condition;

means connecting the jaw member to the frame member and operative for moving the jaw member toward the lower horizontal portion of the frame member to position the hanger ends in gripping adjacency and retention with the gripping structure when the trolley is in the locked condition, and operative for moving the jaw member away from the lower horizontal portion of the frame member to release the hanger ends for free suspension on the gripping structure and to provide an access opening in the space between the gripping structure and the jaw member when the trolley is in the unlocked condition;

selectively operable locking and unlocking means operatively connected between the jaw member and the frame member for maintaining the jaw member positioned toward the lower portion of the frame member to maintain the locked condition of the trolley and for releasing the jaw member for movement away from the gripping structure to achieve the unlocked condition of the trolley; and structural means the resilient gripping structure for increasing the compressibility of the resilient gripping structure over the compressibility provided by the resiliency of the material itself from which the gripping structure is formed.

31. A locking trolley as defined in claim 30 wherein the structural means includes holes formed transversely through the gripping structures.

32. A locking trolley as defined in claim 30 wherein the structural means includes a web portion of the gripping pad of transverse width less than the transverse width of a portion of the gripping structure which contacts the hooked ends of hangers.

* * * * *